US006145133A

United States Patent [19]

Sato et al.

[11] Patent Number: 6,145,133

[45] Date of Patent: Nov. 14, 2000

[54] SWIMMING GOGGLES

[75] Inventors: Hiromasa Sato; Shunji Fukasawa, both of Tokyo, Japan

[73] Assignee: Tabata Co., Ltd., Japan

[21] Appl. No.: 09/505,610

[22] Filed: Feb. 17, 2000

[30] Foreign Application Priority Data

Feb. 17, 1999 [JP] Japan ..... 11-039250

[51] Int. Cl.[7] ..... A61F 9/02

[52] U.S. Cl. ..... 2/428; 2/445

[58] Field of Search ..... 2/428, 430, 445, 2/446, 440, 439, 452; 351/43

[56] References Cited

U.S. PATENT DOCUMENTS 5,313,671 5/1994 Flory ..... 2/445 X
5,515,551 5/1996 Yashiro ..... 2/428
5,884,339 3/1999 Fukasawa ..... 2/446

FOREIGN PATENT DOCUMENTS 8-257051 10/1996 Japan .
2570206 2/1998 Japan .

*Primary Examiner*—Peter Nerbun
*Attorney, Agent, or Firm*—Baker & Daniels

[57] ABSTRACT

Swimming goggles that include a pair of lens assemblies each having an inner end portion formed with a recess and an end wall extending forward. A bridge is formed at each end with an outer leg, an inner leg and an intermediate leg. The outer leg is adapted to be firmly engaged with the recess of the lens assembly and cooperate with the inner leg to retain the end wall therebetween. The intermediate leg is adapted to be firmly engaged with a groove formed in the end wall. The swimming goggles thus constructed allow the bridge to be firmly engaged with the lens assemblies.

7 Claims, 4 Drawing Sheets

SWIMMING GOGGLES

BACKGROUND OF THE INVENTION

This invention relates to goggles adapted to be used by swimmers or divers.

Japanese Utility Model Registration Gazette No. 2570206 discloses swimming goggles basically comprising a pair of lens assemblies and a bridge used to join inner ends of the respective lens assemblies to each other across the nose of a goggles wearer. The bridge has its opposite ends adapted to be inserted into locking slits extending through the respective lens assemblies from the front toward the rear. Each of the locking slits is formed at an inlet thereof with a pair of pawls which are opposed to each other so as to define a groove therebetween. Each end of the bridge inserted into the associated locking slit is caught and retained by the groove from the front of the associated lens assembly. Stop projections formed on surfaces of the bridge are engaged with the respective pairs of pawls so that the bridge can not fall off from the locking slits.

Japanese Patent Application Disclosure Gazette (Kokai) No. Hei8-257051 discloses goggles including a bridge adapted to join inner ends of paired main bodies to each other. The bridge is shaped to be transversely larger and provided with a pair of locking legs extending rearward from a rear surface of the bridge. Each of the main bodies is formed at the inner end thereof with a locking slit extending therethrough from the front toward the rear. Insertion of the locking legs into the respective locking slits from the front of lens assemblies causes lateral projections formed on inner or outer surfaces of the respective locking legs to be engaged with edges of the locking slits from outside of these slits so that the locking legs can not fall off from the respective slits.

These known swimming goggles are similar to each other in that the opposite ends of the strap itself or the pair of locking legs formed thereon are inserted into the locking slits extending through the respective lens assemblies and thereby the lens assemblies are joined together. Both the opposite ends of the strap itself and the locking legs extending therefrom are formed on its outer or inner surface with the stop projections serving to prevent the locking legs or the opposite ends of the strap itself from falling off from the respective locking slits. The locking slits are generally dimensioned to be slightly larger than a diameter of the strap itself or the locking legs so that the locking slits may allow the stop projections formed thereon to pass through the locking slits together with the strap itself or the locking legs. Such dimensional relationship may often cause a relative movement of the lens assemblies and the bridge and, as a result, undesired distortion or misalignment may often occur between these lens assemblies and bridge, since the strap or locking legs can not be in close contact with the inner surfaces of the respective locking slits.

SUMMARY OF THE INVENTION

It is an object of this invention to provide swimming goggles having a bridge can be firmly engaged with the lens assemblies without distortion or misalignment of the lens assemblies relative to the bridge.

According to this invention, there is provided swimming goggles comprising a pair of hard lens assemblies each having transversely inner and outer ends, a bridge made of soft and elastic material by which the inner ends of the respective lens assemblies, and a head strap adapted to connect the outer ends of the respective lens assemblies and to be fastened around the head of a goggles wearer, wherein: the inner end is successively formed from the inner end toward the outer end in a transverse direction of the lens assembly with an end wall extending forwardly of the lens assembly and a bridge receiving recess lying adjacent the end wall and extending rearward from the front of the lens assembly wherein a forward end portion of the end wall is formed with a locking groove having a width progressively enlarging from the front toward the rear; and the bridge is formed with a pair of outer legs lying at outermost opposite ends thereof as viewed in the transverse direction and destined to be inserted into the respective recesses, a pair of inner legs each lying inside the associated one of the outer legs and adapted to cooperate with the outer leg so as to retain the associated one of the end walls therebetween from right and left sides, respectively, and wedge-like portions each extending between the outer and inner legs with a width enlarged from the front toward the rear so that the wedge-like portion is firmly engaged with the locking groove.

It is also possible to exploit this invention in manners as follows:

The bridge includes a bridge portion extending between the outer legs and configured to have a relatively small thickness in the vicinity of said respective inner legs.

The receiving recess comprises a through-hole opened toward the front as well as toward the rear.

The outer leg is adapted to be firmly engaged with an inner surface of the receiving recess.

The receiving recess has an opening of the same rectangular shape as a cross-section of the outer leg so that a peripheral surface of the outer leg comes in close contact with the inner surface of the receiving recess.

The inner leg is adapted to come in close contact with a side surface of the end wall.

DESCRIPTION OF THE PREFERRED EMBODIMENTS

Figure 1:
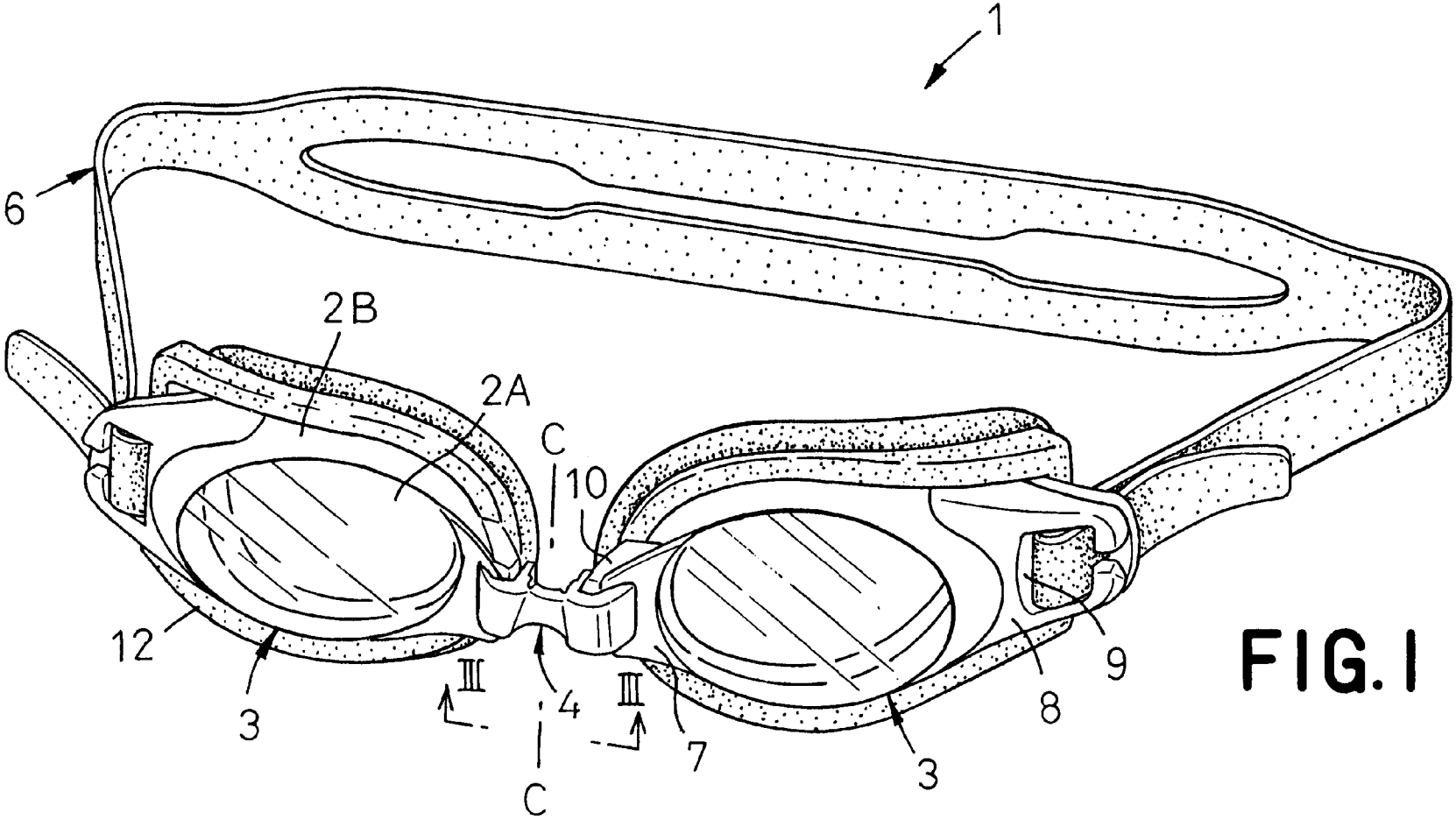
FIG. 1 is a perspective view of a pair of swimming goggles according to this invention.

The swimming goggles 1 shown by FIG. 1 in a perspective view are arranged so that a pair of lens assemblies 3, each comprising a lens 2A and a frame 2B which are integrally molded, are joined together by a bridge 4 lying in front of a swimming goggles wearer and a head strap 6 adapted to be fastened around the wearer's head. Each of the lens assemblies 3 is made of hard plastic and formed at its transversely inner end 7 lying adjacent the nose of the wearer with an end wall 10 protruding forward, by which the bridge 4 can be detachably locked to the lens assemblies 3. An outer end 8 of the lens assemblies 3 lying nearer to the back of the wearer's head is formed with a strap guiding hole 9 through which the head strap 6 is length-adjustably guided. A flange 11 (See FIG. 3) formed around the lens assemblies 3 carries an annular cushioning pad 12 made of soft and elastic material.

Figure 2:
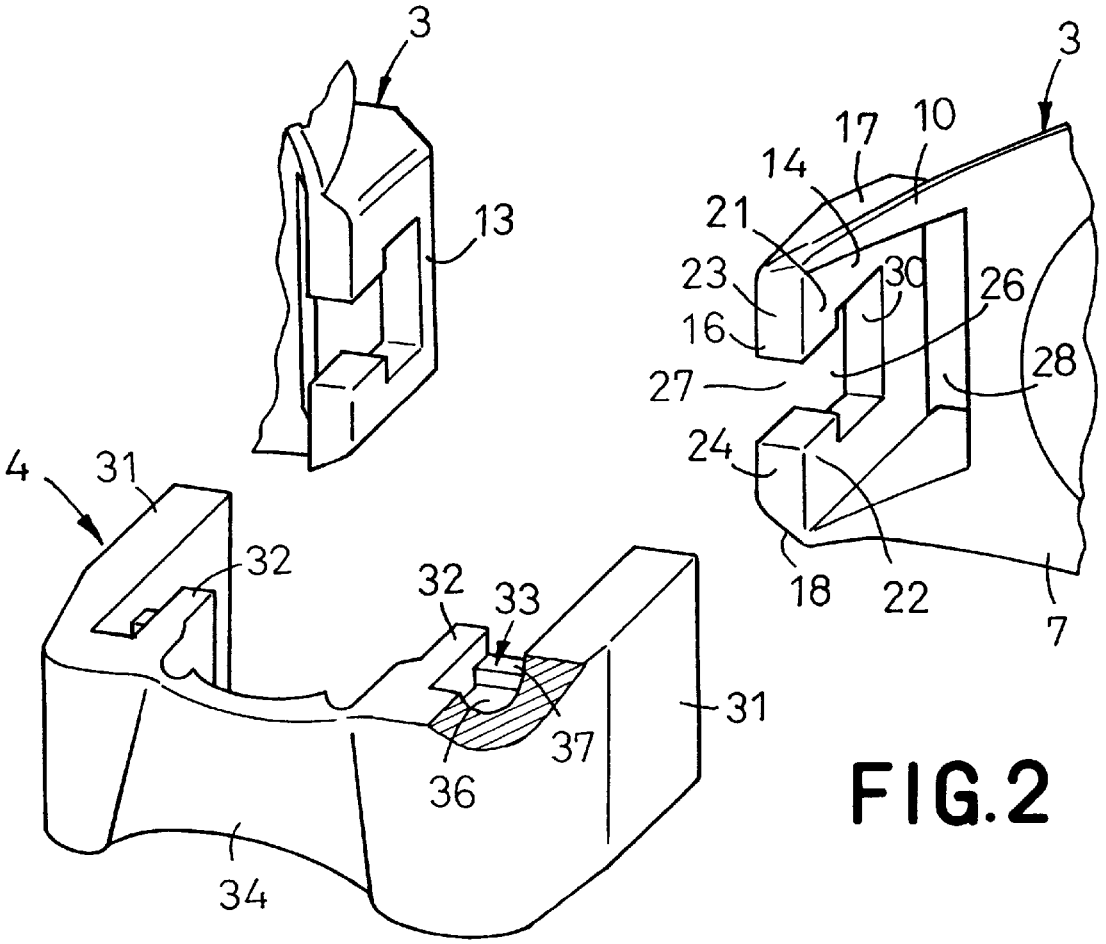
FIG. 2 is a fragmentary exploded perspective view of the swimming goggles shown in FIG. 1.

FIG. 2 is an exploded perspective view of elements of the bridge 4 shown as the bridge is detached from the lens assemblies 3 in the swimming goggles shown in FIG. 1. At the inner end 7 of the lens assembly 3, the end wall 10 has an inner surface 13 lying most adjacent to a center line C—C (See FIG. 1) that divides the swimming goggles 1 in right and left halves, an outer surface 14 extending substantially in parallel to the inner surface 13, a front end surface 16 connecting the inner and outer surfaces 13, 14 to each other, and upper and lower surfaces 17, 18. A front end of the end wall 10 is branched into upper and lower arms 21, 22 wherein the upper arm 21 has a forward end 23 extending downward while the lower arm 22 has a forward end 24 extending upward so that these two arms 21, 22 define a substantially T-shaped groove 26. The groove 26 has a relatively small opening 27 in the front end surface 16 and the opening 27 is vertically enlarged at a rear region 30 lying in the vicinity of a proximal end of the end wall 10. In the vicinity of the outer surface 14 of the end wall 10, the inner end 7 extends from the front toward the rear of the lens assembly 3 and has a recess 28 adapted to engaged with the bridge 4. The recess 28 preferably has a rectangular opening.

The bridge 4 is made of soft and elastic material and is shaped to be transversely larger. The bridge 4 is formed at its ends with outer legs 31 each extending from the front toward the rear of the lens assemblies 3. Inside the outer leg 31, the bridge 4 is formed with an inner leg 32 substantially parallel to the outer leg 32 and an intermediate leg 33 connecting those two legs 31, 32. A pair of the outer legs 31 are connected by a bridge portion 34.

Figure 3:
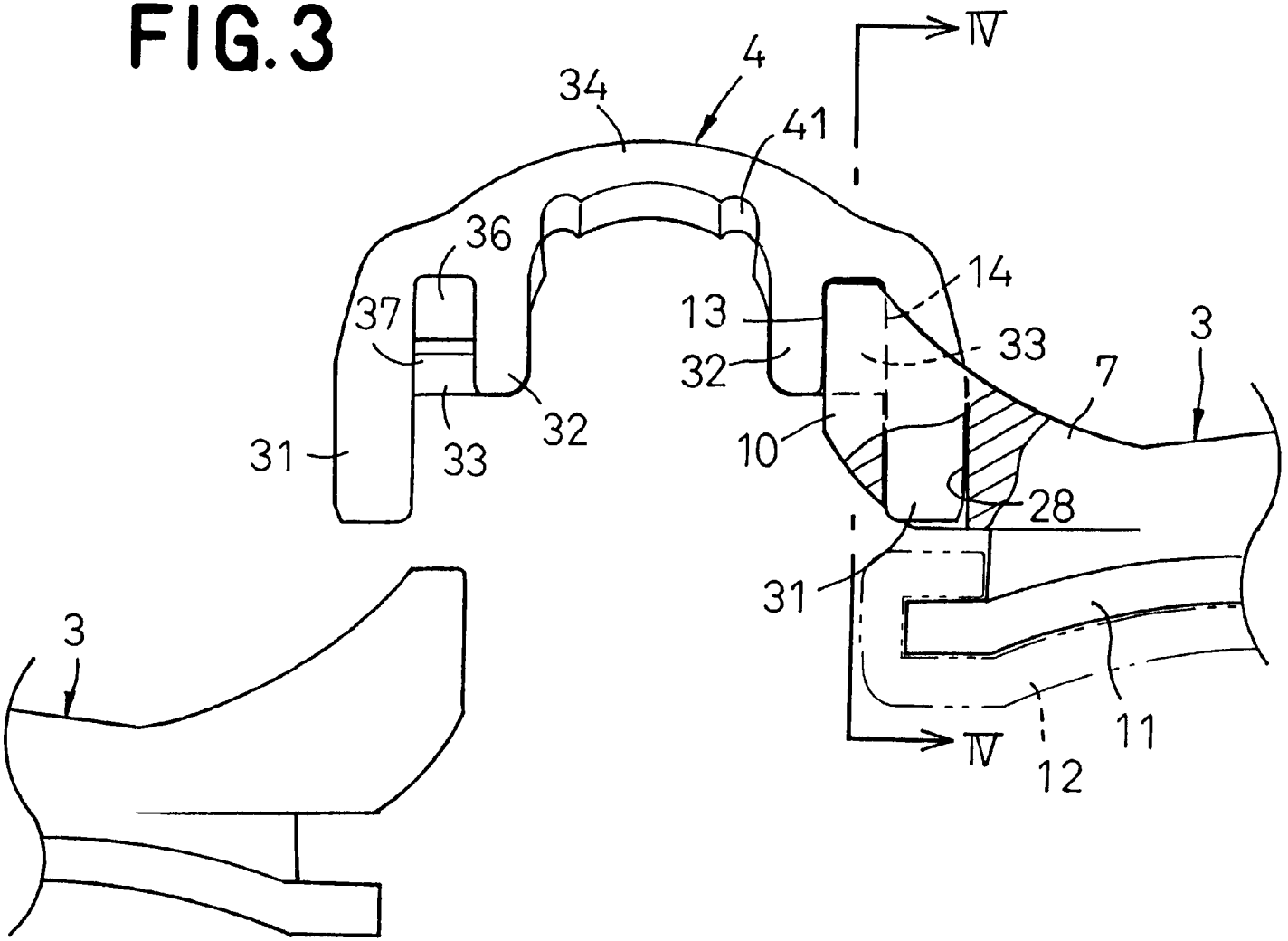
FIG. 3 is a sectional view as taken along a line III—III in FIG. 1 and viewed in the direction as indicated by arrows in the same figure.
Figure 4:
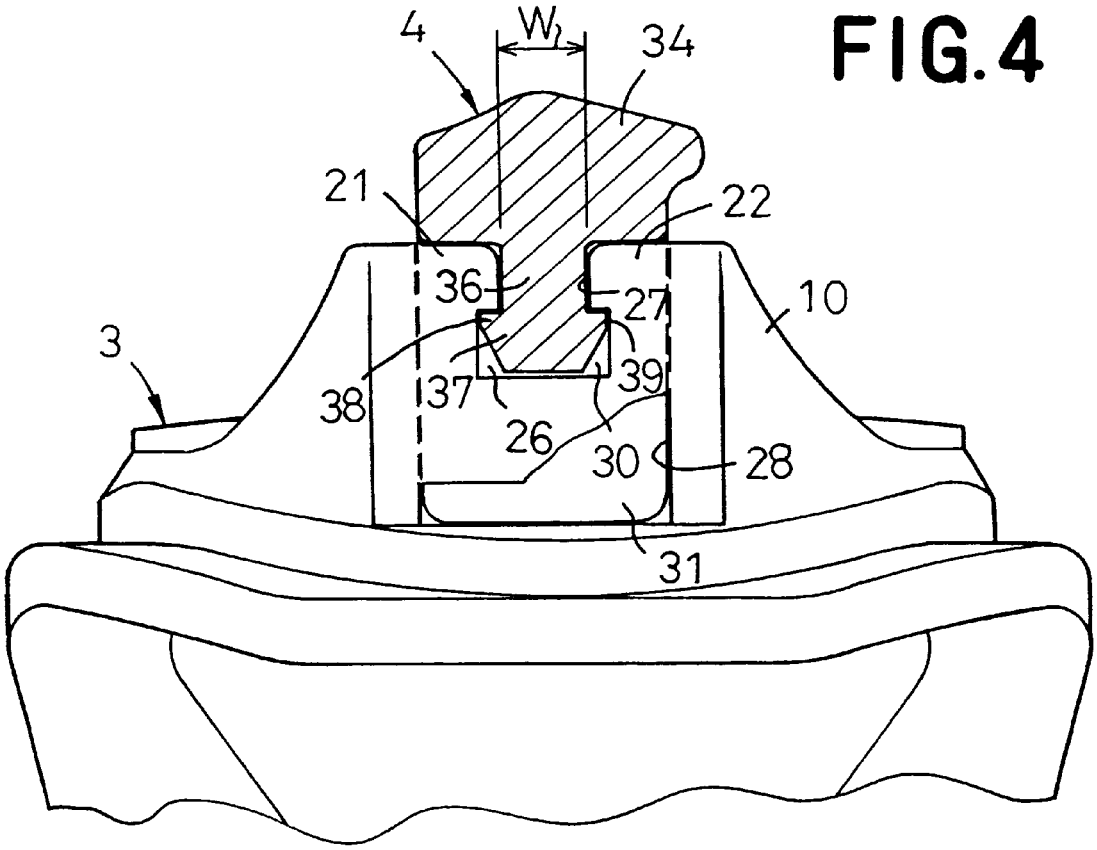
FIG. 4 is a sectional view taken along a line IV—IV in FIG. 3 and viewed in the direction as indicated by arrows in the same figure.

FIG. 3 is a sectional view taken along a line III—III in FIG. 1 and viewed in the direction as indicated by arrows in the same figure and FIG. 4 is a sectional view taken along a line IV—IV in FIG. 3 and viewed in the direction as indicated by arrows in the same figure. It should be understood that FIGS. 3 and 4 are the sectional views partially cutaway and FIG. 3 shows the lens assembly 3 and the bridge 4 as partially disengaged from each other. The outer leg 31 has a cross-section substantially identical to the opening shape of the recess 28 so that said outer leg 31 comes in contact with the outer surface 14 of the end wall 10 and has its peripheral surface come in close contact with the inner surface of the recess 28 as the outer leg 31 is inserted into the recess 28. The recess 28 extending rearward from the front of the lens assembly 3 toward a face of the swimming goggles wearer is rearward opened in order to prevent a quantity of air within the recess 28 from obstructing insertion of the outer leg 31 thereinto. The forward end of the outer leg 31 extends just to this rear opening. The inner leg 32 contacts with the inner surface 13 of the end wall 10 and thereby cooperates with the outer leg 31 to retain the end wall 10 from both sides as viewed in FIG. 3. The inner leg 32 is configured to be shorter than the outer leg 31 and to be placed against only a portion of the inner surface 13 which is substantially vertical. As will be apparent from FIG. 3, the intermediate leg 33 has a narrow proximal end portion 36 extending downward from the bridge portion 34 and a relatively wide distal end portion 37 defined below the proximal end portion 36. A width W of the proximal end portion 36 (See FIG. 4) is dimensioned to be substantially corresponding to a width of the opening 27 defined by the groove 26 of the lens assembly 3, more preferably to come in close contact with the inner surface of the opening 27. The distal end portion 37 is substantially wedge-shaped to ensure that the distal end portion 37 can be easily inserted into the groove 26 to the rear end 30 of the groove 26. Transversely opposite side protuberances 38, 39 of the distal end portion 37 cooperate with the bridge portion 34 to retain the upper and lower arms 21, 22 of the end wall 10 from below and above. The side protuberances 38, 39 placed against the upper and lower arms 21, 22 from below prevent the bridge 4 from falling off from the lens assembly 3. As will be understood from FIG. 3, the bridge portion 34 of the bridge 4 is configured to have relatively thin regions 41 on its inner side in the vicinity of the proximal ends of the respective inner legs 32. The presence of such regions 41 facilitates a curvature of the circular arc described by the bridge portion 34 to be selectively adjusted when the swimming goggles 1 are put on.

With the swimming goggles 1 having the lens assembly 3 and the bridge 4 arranged as has been described above, engagement of the intermediate legs 33 with the grooves 26 ensures that the lens assemblies 3 and the bridge 4 are reliably maintained in a firm engagement without a significant misalignment between them in the vertical direction as viewed in FIG. 1. On the other hand, a relative misalignment of the leg assemblies 3 and the bridge 4 in the transverse direction as viewed in FIG. 1 is minimized by bringing the respective outer legs 31 in close contact with the inner surfaces of the associated recesses 28 and retaining the end wall 10 between the respective outer legs 31 and the associated inner legs 32. In this manner, the bridge 4 is firmly engaged with the lens assemblies 3 so that neither significant distortion nor significant misalignment might occur between the lens assemblies, facilitating the swimming goggles 1 to be put on and used.

To exploit this invention, the lens assemblies 3 may be molded from hard plastic such as polycarbonate. While the lens assembly 3 has been illustrated and described to comprise the integrally molded lens 2A and the frame 2B, it is also possible without departing from the spirit and the scope of this invention to combine a separately prepared lens with a separately prepared frame. The bridge 4 may be molded from soft and elastic material such as natural or synthetic rubber. Hardness of each material may be appropriately adjusted.

The swimming goggles according to this invention allow the bridge to be firmly joined with the lens assembly without their relative distortion and misalignment since the bridge is closely engaged with the lens assembly by the outer, inner and intermediate legs formed on the bridge.

What is claimed is:

1. Swimming goggles comprising a pair of lens assemblies each having transversely inner and outer ends;

a bridge made of an elastic material to which said inner ends of the respective lens assemblies are coupled; and a head strap to which said outer ends of the respective lens assemblies are coupled each of said inner ends of said lens assemblies is provided with an end wall that extends forwardly of said respective lens assembly, each of said inner ends of said lens assemblies is further provided with a bridge receiving recess that lies adjacent said end wall and [extending] extends rearward from a front of said respective lens assembly, a forward end portion of each of said end walls is provided with a locking groove that has a width that is increased from a front thereof toward a rear thereof [rear; and]

said bridge is provided with a pair of outer legs that lie at outermost opposite ends thereof which outer legs are configured to be insertable into the respective bridge receiving recesses said bridge is further provided with a pair of inner legs each located inwardly from said outer legs, each of said pair of inner legs being configured to cooperate with an adjacent one of said outer legs so as to receive and retain one of said end walls of said lens assemblies therebetween, said bridge is further provided with wedge structures that extend between said outer and inner legs and which have widths that are enlarged from front toward rear portions thereof so that said wedge structures can be firmly engaged with said locking grooves.

2. Swimming goggles according to claim 1, wherein said bridge includes a bridge portion that extends between said outer legs and is configured to have a reduced thickness in the vicinity of said respective inner legs.

3. Swimming goggles according to claim 1, wherein said bridge receiving recesses comprise through-holes that are opened toward the front as well as toward the rear of the lens assemblies.

4. Swimming goggles according to claim 1, wherein each of said outer legs is configured to be firmly engaged with an inner surface of said bridge receiving recesses.

5. Swimming goggles according to claim 4, wherein each of said bridge receiving recesses has an opening that is complementarily shaped to a cross-section of said outer legs of said lens assemblies so that a peripheral surface of said outer legs comes in close contact with the inner surface of said bridge receiving recesses.

6. Swimming goggles according to claim 1, wherein each of said inner legs of said bridge is configured to come into close contact with a side surface of said end walls of said lens assemblies.

7. Swimming goggles according to claim 1, wherein each of said outer legs of said bridge is longer than each of said inner legs of said bridge.

* * * * *